US011453933B2

(12) United States Patent
Um et al.

(10) Patent No.: US 11,453,933 B2
(45) Date of Patent: *Sep. 27, 2022

(54) HIGH-STRENGTH STEEL MATERIAL HAVING ENHANCED RESISTANCE TO CRACK INITIATION AND PROPAGATION AT LOW TEMPERATURE AND METHOD FOR MANUFACTURING THE SAME

(71) Applicant: POSCO, Pohang-si (KR)

(72) Inventors: Kyung-Keun Um, Pohang-si (KR); Woo-Gyeom Kim, Pohang-si (KR); Woo-Yeol Cha, Pohang-si (KR); Jin-Woo Chae, Pohang-si (KR)

(73) Assignee: POSCO, Pohang-si (KR)

( * ) Notice: Subject to any disclaimer, the term of this patent is extended or adjusted under 35 U.S.C. 154(b) by 148 days.

This patent is subject to a terminal disclaimer.

(21) Appl. No.: 16/471,780

(22) PCT Filed: Dec. 22, 2017

(86) PCT No.: PCT/KR2017/015411

§ 371 (c)(1),
(2) Date: Jun. 20, 2019

(87) PCT Pub. No.: WO2018/117767

PCT Pub. Date: Jun. 28, 2018

(65) Prior Publication Data

US 2020/0087765 A1 Mar. 19, 2020

(30) Foreign Application Priority Data

Dec. 23, 2016 (KR) ..... 10-2016-0178103

(51) Int. Cl.
*B32B 15/00* (2006.01)
*C22C 38/44* (2006.01)
(Continued)

(52) U.S. Cl.
CPC ..... *C22C 38/44* (2013.01); *C21D 8/0226* (2013.01); *C21D 8/0247* (2013.01);
(Continued)

(58) Field of Classification Search
None
See application file for complete search history.

(56) References Cited

U.S. PATENT DOCUMENTS

2010/0258219 A1 10/2010 Ahn et al.
2010/0263773 A1 10/2010 Cho et al.
(Continued)

FOREIGN PATENT DOCUMENTS

CN 101413085 A 4/2009
CN 101535518 A 9/2009
(Continued)

OTHER PUBLICATIONS

Chinese Office Action dated Jul. 22, 2020 issued in Chinese Patent Application No. 201780079895.4 (with English translation).
(Continued)

*Primary Examiner* — Seth Dumbris
(74) *Attorney, Agent, or Firm* — Morgan, Lewis & Bockius LLP

(57) ABSTRACT

An aspect of the present disclosure relates to a high-strength steel material having enhanced resistance to crack initiation and propagation at low temperature.

10 Claims, 2 Drawing Sheets

(51) Int. Cl.

| | |
|---|---|
| ***C21D 8/02*** | (2006.01) |
| ***C21D 9/00*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/46*** | (2006.01) |
| ***C22C 38/50*** | (2006.01) |
| ***C22C 38/58*** | (2006.01) |

(52) U.S. Cl.

CPC ..... *C21D 9/0081* (2013.01); *C22C 38/001* (2013.01); *C22C 38/02* (2013.01); *C22C 38/06* (2013.01); *C22C 38/42* (2013.01); *C22C 38/46* (2013.01); *C22C 38/50* (2013.01); *C22C 38/58* (2013.01); *C21D 2211/001* (2013.01); *C21D 2211/008* (2013.01)

(56) References Cited

U.S. PATENT DOCUMENTS

| | | | | |
|---|---|---|---|---|
| 2012/0018056 | A1* | 1/2012 | Nakagawa | C22C 38/46 148/506 |
| 2013/0037162 | A1 | 2/2013 | Shinohara et al. | |
| 2013/0292011 | A1 | 11/2013 | Kim et al. | |
| 2017/0002435 | A1 | 1/2017 | Jeong et al. | |

FOREIGN PATENT DOCUMENTS

| | | | | | |
|---|---|---|---|---|---|
| CN | 103361554 | A | | 10/2013 | |
| CN | 105525213 | A | | 4/2016 | |
| CN | 105829565 | A | | 8/2016 | |
| EP | 2832889 | A1 | | 2/2015 | |
| EP | 3026140 | A1 | | 6/2016 | |
| EP | 3042976 | A1 | | 7/2016 | |
| JP | H07-070628 | A | | 3/1995 | |
| JP | 2002-194488 | | * | 7/2002 | C21D 8/02 |
| JP | 2002-194488 | A | | 10/2002 | |
| JP | 2013-095928 | A | | 5/2013 | |
| JP | 2014-505170 | A | | 2/2014 | |
| KR | 10-2002-0028203 | A | | 4/2002 | |
| KR | 10-2009-0052950 | A | | 5/2009 | |
| KR | 10-2009-0066639 | A | | 6/2009 | |
| KR | 10-2009-0070484 | A | | 7/2009 | |
| KR | 1020090070484 | | * | 5/2010 | |
| KR | 10-2011-0025871 | A | | 3/2011 | |
| KR | 10-2012-0062017 | A | | 6/2012 | |
| KR | 10-2013-0131105 | A | | 12/2013 | |
| KR | 10-2014-0023787 | A | | 2/2014 | |
| KR | 10-2015-0075292 | A | | 7/2015 | |
| KR | 10-2016-0014087 | A | | 2/2016 | |
| WO | 2008/054166 | A1 | | 5/2008 | |
| WO | 2011/030768 | A1 | | 3/2011 | |
| WO | 2015/012317 | A1 | | 1/2015 | |
| WO | 2015/030210 | A1 | | 3/2015 | |
| WO | 2015/099373 | A1 | | 7/2015 | |

OTHER PUBLICATIONS

Extended European Search Report dated Nov. 29, 2019 issued in European Patent Application No. 17884049.2.

Written Opinion and International Search Report dated Mar. 29, 2018 issued in International Patent Application No. PCT/KR2017/015411 (with English translation).

* cited by examiner

【FIG. 1】
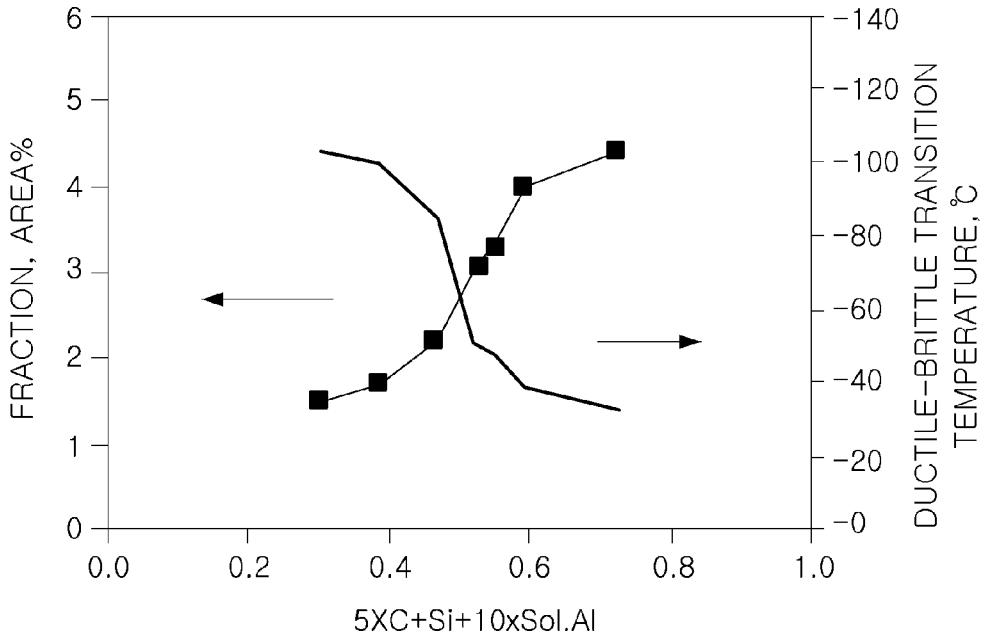
【FIG. 2】
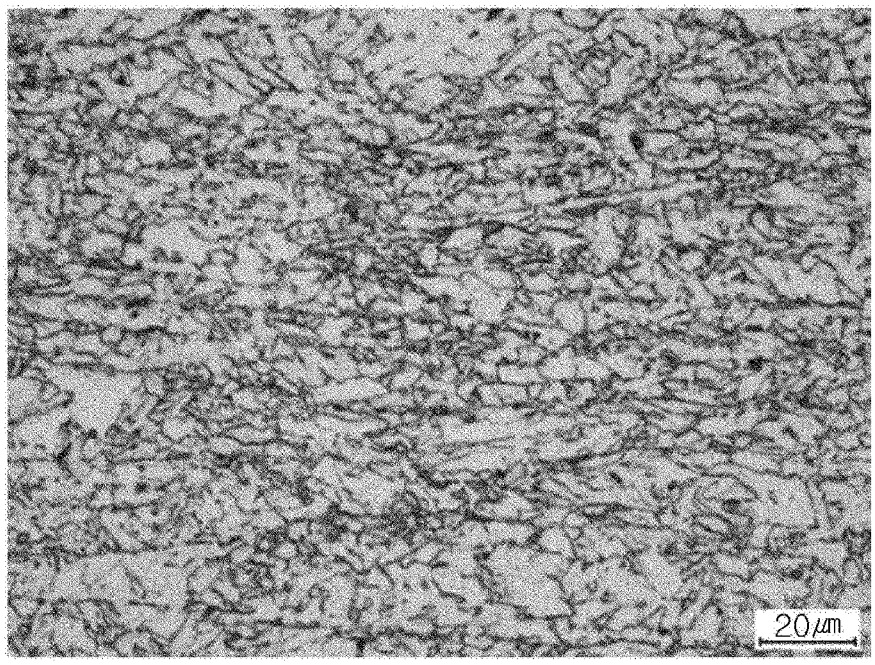

【FIG. 3】
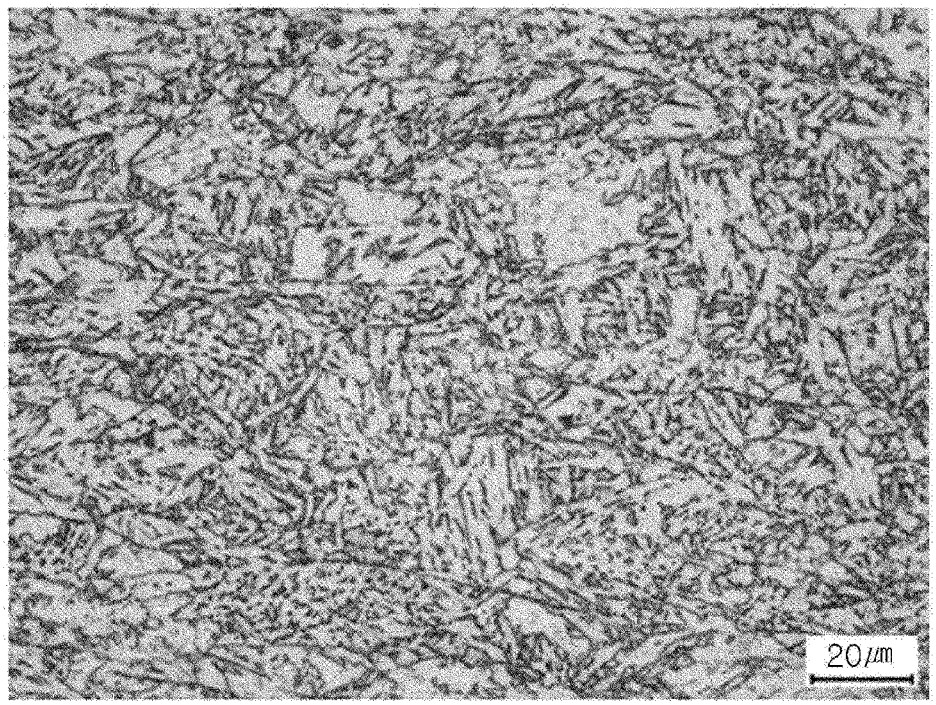

HIGH-STRENGTH STEEL MATERIAL HAVING ENHANCED RESISTANCE TO CRACK INITIATION AND PROPAGATION AT LOW TEMPERATURE AND METHOD FOR MANUFACTURING THE SAME

CROSS-REFERENCE OF RELATED APPLICATIONS

This application is the U.S. National Phase under 35 U.S.C. § 371 of International Patent Application No. PCT/KR2017/015411, filed on Dec. 22, 2017, which in turn claims the benefit of Korean Patent Application No. 10-2016-0178103, filed Dec. 23, 2016, the entire disclosures of which applications are incorporated by reference herein.

TECHNICAL FIELD

The present disclosure relates to a high-strength steel material, having enhanced resistance to crack initiation and propagation at low temperature, which may be preferably applied to steel for a shipbuilding and marine structure, and a method for manufacturing the same.

BACKGROUND ART

With the depletion of energy resources, the mining is gradually shifting to deep-sea or extreme cold regions, and structures of mining and storage facilities are becoming larger and more complicated. Therefore, a steel material to be used therein becomes thicker, and has a tendency to be strengthened, to reduce weight of the structures.

As the steel material becomes thicker and stronger, the amount of alloy components to be added may increase, and the addition of a relatively large amount of alloy components may cause a problem of deteriorating toughness in a welding process.

The reasons why toughness of a weld heat-affected zone deteriorates are as follows.

In the heat-affected zone exposed to high temperature of 1200° C. or higher during the welding process, not only a microstructure thereof may be coarsened due to the high temperature, but also a hard micro structure at low temperature may increase due to a subsequent rapid cooling rate, to deteriorate toughness at low temperature. In addition, the heat-affected zone may undergo various temperature change histories due to welding of various passes. Particularly, in a region in which a final pass passes a two phase temperature region of austenite-ferrite, austenite may be generated by reverse transformation, and C in the peripheral portion may be gathered and become concentrated. In a subsequent cooling, a portion thereof may be transformed into martensite of high hardness, or may remain as austenite due to increased hardenability. This refers to martensite-austenite composite phase or MA phase. The MA phase with high hardness may not only have a sharp shape to give a high concentration of stress, but may also act as an initiation point of fractures by concentrating deformation of a soft ferrite matrix in the peripheral portion due to the high hardness. Therefore, in order to increase resistance to crack initiation and propagation at low temperature, the generation of MA phase in the heat-affected zone during the welding process should be preferentially minimized. Furthermore, since the break initiation and propagation becomes easier as a temperature of the use environment is lowered as in the polar zone, it is necessary to further suppress the MA phase.

In order to solve the above-mentioned problems, there have been developed: (1) a method for producing fine inclusions in a steel material such that dense needle-like ferrite is formed by inclusions in the cooling process after the weld heat-affected zone is coarsened at a high temperature, while suppressing the MA phase (in general, referring to as oxide metallurgy); (2) a method of reducing an addition amount of C, Si, Mn, Mo, Sol.Al, Nb, etc. which promotes the generation of the MA phase by increasing the stability of the austenite generated upon heating to the two phase region; (3) a method of greatly increasing the content of Ni, which may be an element for improving low-temperature toughness of the ferrite matrix to needle-shaped ferrite or various bainites; (4) a method of reheating the heat-affected zone in a welding process to a temperature of 200° C. to 650° C., after the welding process, and decomposing the prepared MA phase to reduce the hardness thereof; and the like.

However, as the structure gradually becomes larger and the use environment changes to the polar environment, there is a problem that it may be difficult to sufficiently secure resistance to brittle crack propagation and break initiation at low temperature by simply applying the above-described conventional methods.

Therefore, there is a demand for development of a high-strength steel material, having enhanced resistance to brittle crack propagation and break initiation at low temperature, and a method for manufacturing the same.

PRIOR ART DOCUMENT (Patent Document 1) Korean Patent Publication No. 2002-0028203

DISCLOSURE

Technical Problem

An aspect of the present disclosure is to provide a high-strength steel material, having enhanced resistance to crack initiation and propagation at low temperature, and a method for manufacturing the same.

Further, the object of the present disclosure is not limited to the above description. In addition, the object of the present disclosure can be understood from the entire contents of the present specification, and it will be understood by those of ordinary skill in the art that there is no difficulty in understanding the additional problems of the present disclosure.

Technical Solution

According to an aspect of the present disclosure, a high-strength steel material, having enhanced resistance to crack initiation and propagation at low temperature, includes, by weight, carbon (C): 0.01% to 0.07%, silicon (Si): 0.002% to 0.2%, manganese (Mn): 1.7% to 2.5%, Sol. aluminum (Sol.Al): 0.001% to 0.035%, niobium (Nb): 0.03% or less (not including 0%), vanadium (V): 0.01% or less (not including 0%), titanium (Ti): 0.001% to 0.02%, copper (Cu): 0.01% to 1.0%, nickel (Ni): 0.01% to 2.0%, chromium (Cr): 0.01% to 0.5%, molybdenum (Mo): 0.001% to 0.5%, calcium (Ca): 0.0002% to 0.005%, nitrogen (N): 0.001% to 0.006%, phosphorus (P): 0.02% or less (not including 0%), sulfur (S): 0.003% or less (not including 0%), oxygen (O):

0.0025% or less (not including 0%), a balance of iron (Fe), and inevitable impurities, and satisfying relational expression (1), wherein a microstructure of the high-strength steel material includes polygonal ferrite and acicular ferrite in a total amount of 30 area % or more, and includes a martensite-austenite composite phase (MA phase) in an amount of 3.0 area % or less:

$$5*C+Si+10*sol.Al \leq 0.5 \quad \text{Relational expression (1):}$$

(In relational expression (1), each symbol of the element refers to a value indicating each element content in weight %.)

According to another aspect of the present disclosure, a method for manufacturing a high-strength steel material, having enhanced resistance to crack initiation and propagation at low temperature, includes:

preparing a slab satisfying the above-described alloy composition;

heating the slab to a temperature of 1000° C. to 1200° C.;

finish hot-rolling the heated slab to at a temperature of 650° C. or higher to obtain a hot-rolled steel sheet; and cooling the hot-rolled steel sheet.

In addition, the solution of the above-mentioned problems does not list all the features of the present disclosure. The various features of the present disclosure, and the advantages and effects thereof can be understood in more detail with reference to the following specific embodiments.

Advantageous Effects

According to an aspect of the present disclosure, a steel material and a method for manufacturing the same, in which resistance to crack initiation and propagation at low temperature may be remarkably enhanced.

DESCRIPTION OF DRAWINGS

FIG. 1 is a graph illustrating changes in MA phase fraction (solid line) and ductility-brittle transition temperature (dotted line) according to values of relational expression (1) for Examples 1 to 3, and Comparative Examples 1, 2, 7, and 8.

FIG. 2 is an image of a microstructure of Inventive Example 1 captured by an optical microscope.

FIG. 3 is an image of a microstructure of Comparative Example 2 captured by an optical microscope.

BEST MODE FOR INVENTION

Hereinafter, preferred embodiments of the present disclosure will be described. However, the embodiments of the present disclosure may be modified into various other forms, and the scope of the present disclosure is not limited to the embodiments described below. Further, the embodiments of the present disclosure are provided to more fully explain the present disclosure to those skilled in the art.

The inventors of the present disclosure have undertaken intensive research to further improve resistance to crack initiation and propagation at low temperature. As a result, the inventors have found that a microstructure of a steel material may be precisely controlled by correlation between the alloying elements, particularly C, Si, and Sol.Al, to include polygonal ferrite and acicular ferrite in a total amount of 30 area % or more, and to include a martensite-austenite composite phase (MA phase) in an amount of 3.0 area % or less, thereby remarkably enhancing resistance to crack initiation and propagation at low temperature, has and accordingly, have accomplished the present disclosure on the basis of these findings.

High-strength steel material, having enhanced resistance to crack initiation and propagation at low temperature Hereinafter, a high-strength steel material, having enhanced resistance to brittle crack propagation and break initiation at low temperature according to one aspect of the present disclosure will be described in detail.

According to one aspect of the present disclosure, there may be provided a high-strength steel material, having enhanced resistance to crack initiation and propagation at low temperature, includes, by weight, carbon (C): 0.01% to 0.07%, silicon (Si): 0.002% to 0.2%, manganese (Mn): 1.7% to 2.5%, Sol. aluminum (Sol.Al): 0.001% to 0.035%, niobium (Nb): 0.03% or less (not including 0%), vanadium (V): 0.01% or less (not including 0%), titanium (Ti): 0.001% to 0.02%, copper (Cu): 0.01% to 1.0%, nickel (Ni): 0.01% to 2.0%, chromium (Cr): 0.01% to 0.5%, molybdenum (Mo): 0.001% to 0.5%, calcium (Ca): 0.0002% to 0.005%, nitrogen (N): 0.001% to 0.006%, phosphorus (P): 0.02% or less (not including 0%), sulfur (S): 0.003% or less (not including 0%), oxygen (O): 0.0025% or less (not including 0%), a balance of iron (Fe), and inevitable impurities, and satisfying relational expression (1), wherein a microstructure of the high-strength steel material includes polygonal ferrite and acicular ferrite in a total amount of 30 area % or more, and includes a martensite-austenite composite phase (MA phase) in an amount of 3.0 area % or less:

$$5*C+Si+10*sol.Al \leq 0.5 \quad \text{Relational expression (1):}$$

(In relational expression (1), each symbol of the element refers to a value indicating each element content in weight %.)

First, the alloy composition of the steel material of the present disclosure will be described in detail. Hereinafter, the content of each component described below is based on weight.

C: 0.01% to 0.07%

C may be an element that plays an important role in forming acicular ferrite or lath bainite to simultaneously secure strength and toughness.

When the C content is less than 0.01%, there may be a problem that the strength and toughness of the steel material may be lowered due to transformation into a coarse ferrite structure with little diffusion of C. When the C content is more than 0.07%, not only a MA phase may be excessively produced, but also a coarse MA phase may be formed, to significantly deteriorate the resistance to crack initiation at low temperature. Therefore, the C content is preferably 0.01 to 0.07%.

Further, a more preferable lower limit of the C content may be 0.015%, and a still more preferable lower limit of the C content may be 0.02%. In addition, a more preferable upper limit of the C content may be 0.065%, and a still more preferable upper limit of the C content may be 0.06%.

Si: 0.002% to 0.2%

Si may be an element that may be generally added for the purpose of solid solution strengthening, in addition to deoxidation and desulfurization effect. Effects of increasing yield and tensile strength may be negligible, while stability of the austenite in the heat-affected zone in the weld process may greatly increase and the fraction of the MA phase may be increased. In the present disclosure, it is preferable to limit it to 0.2% or less. However, in order to control the Si content to less than 0.005%, the treatment time in the steelmaking process may greatly increase, resulting in an increase in production cost and a decrease in productivity. Therefore, a lower limit of the Si content is preferably 0.002%.

Further, a more preferable lower limit of the Si content may be 0.005%, and a still more preferable lower limit of the Si content may be 0.006%. Further, a more preferable upper limit of the Si content may be 0.15%, and a still more preferable upper limit of the Si content may be 0.1%.

Mn: 1.7% to 2.5%

Mn may have a large effect of increasing the strength by solid solution strengthening, and may not greatly decrease toughness at low temperature, so it may be added by 1.7% or more. More preferably 1.8% or more in order to sufficiently secure the strength.

When Mn is added excessively, segregation may become serious in a central portion in a thickness direction of the steel sheet, and at the same time, promote formation of MnS, which may be a non-metallic inclusion, together with segregated S. The MnS inclusions produced in the central portion may be stretched by a subsequent rolling operation, and as a result, the resistance to brittle crack propagation and break initiation at low temperature may be significantly lowered, such that an upper limit of the Mn content is preferably 2.5%.

Therefore, the Mn content is preferably 1.7% to 2.5%. Further, a more preferable lower limit of the Mn content may be 1.75%, and a still more preferable lower limit of the Mn content may be 1.8%. Further, a more preferable upper limit of the Mn content may be 2.4%, and a still more preferable upper limit of the Mn content may be 2.2%.

Sol.Al: 0.001% to 0.035%

Sol.Al may be used as a strong deoxidizer in the steelmaking process, in addition to Si and Mn, and at least 0.001% should be added at the time of single or complex deoxidation to obtain sufficient such effect.

When the content of Sol.Al exceeds 0.035%, the above-mentioned effect may be saturated, a fraction of $Al_2O_3$ in the oxidative inclusions produced as a result of deoxidation may increase more than necessary, a size of the inclusions may becomes large, and the Sol.Al may not easily be removed during refining. Therefore, there may be a problem that the low temperature toughness of the steel material may be greatly reduced. Also, similarly to Si, the generation of the MA phase in the weld heat-affected zone may be promoted, and the resistance to brittle crack initiation and propagation at low temperature may be greatly reduced.

Therefore, the content of Sol.Al is preferably 0.001 to 0.035%.

Nb: 0.03% or less (not including 0%)

Nb may be dissolved in the austenite during a reheating operation of a slab to increase hardenability of the austenite, and may precipitate into fine carbonitrides (Nb,Ti) (C,N) during a hot-rolling operation, to inhibit recrystallization during rolling or cooling operation, thereby having a very large effect to make a final microstructure in relatively fine size. When Nb is added in an excessively large amount, the generation of the MA phase in the weld heat-affected zone may be promoted, and the resistance to crack initiation and propagation at low temperature may be significantly lowered. Therefore, the Nb content in the present disclosure may be limited to 0.03% or less (not including 0%).

V: 0.01% or less (not including 0%)

V may be almost completely re-dissolved at the time of reheating of the slab, and it may be mostly precipitated during a cooling operation, after a rolling operation, to improve strength. In the weld heat-affected zone, it dissolves at high temperature to greatly increase hardenability, thereby promoting the formation of MA phase. Therefore, the V content in the present disclosure may be limited to 0.01% or less (not including 0%).

Ti: 0.001% to 0.02%

Ti may have an effect of suppressing crystal grain growth of the base material and the weld heat-affected zone, by being mainly in the form of fine hexagonal TiN type precipitates at high temperatures, or forming precipitates of (Ti,Nb) (C,N) precipitates, when adding them such as Nb, or the like.

In order to sufficiently secure the above-mentioned effects, it is preferable to add Ti in an amount of 0.001% or more, and in order to maximize the effects, it is preferable to increase it in accordance with the content of N added. When the Ti content is more than 0.02%, coarse carbonitride may be produced more than necessary, which acts as an initiation point of the fracture crack, which may greatly reduce the impact characteristics of the weld heat-affected zone. Therefore, the Ti content is preferably 0.001% to 0.02%.

Cu: 0.01% to 1.0%

Cu may be an element capable of significantly improving the strength by solid solubilization and precipitation, without greatly deteriorating resistance to brittle crack propagation and break initiation.

When the Cu content is less than 0.01%, the above-mentioned effect may be insufficient. When the Cu content exceeds 1.0%, cracks may be generated on the surface of the steel sheet, and Cu may be an expensive element, causing a problem of rise in costs.

Ni: 0.01% to 2.0%

Ni may have almost no effect of increasing the strength, but may be effective in improving resistance to crack initiation and propagation at low temperature. In particular, when Cu is added, Ni may have an effect of suppressing surface cracking due to selective oxidation occurring when reheating the slab.

When the Ni content is less than 0.01%, the above-mentioned effect may be insufficient. Ni may be an expensive element, and when the content thereof exceeds 2.0%, there may be a problem of rise in costs.

Cr: 0.01% to 0.5%

Cr may have a small effect of increasing the yield and tensile strength due to solid solubilization, but may have an effect of improving strength and toughness by allowing fine materials to be formed at a slow cooling rate of a thick plate material because of its high hardenability.

When the Cr content is less than 0.01%, the above-mentioned effect may be insufficient. When the Cr content exceeds 0.5%, not only the costs may increase, but also the low temperature toughness of the weld heat-affected zone may deteriorate.

Mo: 0.001% to 0.5%

Mo may have effects of delaying the phase transformation in the accelerated cooling process and consequently increasing the strength, and may be an element having an effect of preventing the deterioration of toughness due to grain boundary segregation of impurities such as P or the like.

When the Mo content is less than 0.001%, the above-mentioned effect may be insufficient. When the Mo content exceeds 0.5%, the generation of the MA phase in the weld heat-affected zone may be promoted due to the high hardenability, and the resistance to crack initiation and propagation at low temperature may greatly deteriorate.

Ca: 0.0002% to 0.005%

When Ca is Al-deoxidized and then added to molten steel during steelmaking, it may be combined with S existing mainly in MnS, thereby suppressing the generation of MnS and forming spherical CaS, to inhibit cracking in the central portion of the steel material. Therefore, Ca should be added in an amount of 0.0002% or more, to sufficiently form added S in CaS.

When Ca is excessively added, excess Ca may be combined with O to form a coarse hard, oxidative inclusion, which may be then stretched and fractured in the subsequent rolling, and act as a crack initiation point at low temperature. Therefore, an upper limit of the Ca content is preferably 0.005%.

N: 0.001% to 0.006%

N may be an element that forms a precipitate together with added Nb, Ti, and Al, and refines the crystal grains of the steel, to improve the strength and toughness of the base material. N may be known as the most representative element to reduce the low-temperature toughness due to aging phenomenon after the cold deformation when it is present in excess atomic state in the excessive addition. It is also known that slabs produced by a continuous casting process may promote surface cracking due to embrittlement at high temperatures.

Therefore, in the present disclosure, the addition amount of N may be limited to the range of 0.001% to 0.006%, in considering of the Ti content of 0.001% to 0.02%.

P: 0.02% or less (not including 0%)

P may play roles of increasing the strength, but may be an element that deteriorates the low temperature toughness. Particularly, there may be a problem that low-temperature toughness may largely deteriorate due to grain boundary segregation in the heat-treated steel. Therefore, it is preferable to control P to be as low as possible. Excessive removal of P from the steelmaking process may be expensive. Therefore, P may be limited to 0.02% or less.

S: 0.003% or less (not including 0%)

S may be a main cause of MnS inclusions mainly in the central portion of the steel sheet in the thickness direction by binding to Mn, thereby deteriorating the low temperature toughness. Therefore, S should be removed as much as possible in the steelmaking process, in order to secure the deformation aging impact characteristics at low temperature. In particular, when the addition amount of Mn may be as high as 1.7% or more as in the present disclosure, it is preferable to maintain the addition amount of S extremely low, because MnS inclusion may be easily produced. Since it may be excessive cost, S should be limited to less than 0.003%.

O: 0.0025% or less (not including 0%)

O may be made into an oxidative inclusion by adding a deoxidizing agent such as Si, Mn, Al, and the like in the steel making process, and then may be removed. When the amount of the deoxidizing agent and the process for removing inclusions are insufficient, the amount of the oxidative inclusions remaining in the molten steel may increase, and the size of the inclusions may increase greatly. The coarse oxidative inclusions which have not been removed in this way may be then left in a crushed form or spherical form during the rolling operation in the steel making process, and may serve as an initiation point of fracture at low temperature or as propagation paths of cracks. Therefore, in order to secure impact characteristics and CTOD characteristics at low temperature, the coarse oxidative inclusions should be suppressed as much as possible, and the O content may be limited to 0.0025% or less.

The remainder of the present disclosure may be iron (Fe). However, in the conventional manufacturing process, impurities which are not intended from the raw material or the surrounding environment may be inevitably incorporated, such that it may not be excluded. These impurities may be not specifically mentioned in this specification, as they may be known to any person skilled in the art of manufacturing.

In this case, the alloy composition of the present disclosure not only satisfies the above-described respective element content, but also C, Si, and Sol.Al should satisfy the following relational expression (1).

$$5*C+Si+10*sol.Al \leq 0.5 \quad \text{Relational expression (1):}$$

(In relational expression (1), each symbol of the element refers to a value indicating each element content in weight %.)

The relationship 1 may be designed in consideration of the influence of each element on the formation of the MA phase. As can be seen from FIG. 1, as the value of relational expression (1) increases, the MA phase fraction increases (dotted line) to increase ductile-brittle transition temperature (solid line), which may be low-temperature impact characteristics of the steel material. For example, as the value of relational expression (1) increases, the low temperature toughness tends to decrease. Therefore, it is preferable to control the value of relational expression (1) to 0.5 or less, in order to sufficiently secure the low-temperature impact characteristics and the CTOD value of the steel material.

In addition, in Sub-Critically Reheated Heat-affected zone (SC-HAZ), which may be the welded portion, especially the most important position for guaranteeing the low temperature CTOD value of welds, the microstructure of the base material may be almost maintained. The MA phase may have an increased microstructure than the base material. Therefore, by controlling the value of relational expression (1) to 0.5 or less, the low temperature impact characteristics and the CTOD value of the welded portion may be sufficiently secured.

The microstructure of the steel according to the present disclosure may include polygonal ferrite and acicular ferrite in a total amount of 30 area % or more, and comprises a martensite-austenite composite phase (MA phase) in an amount of 3.0 area % or less.

The acicular ferrite may be the most important and basic microstructure, not only to increase the strength due to the fine grain size effect, but also to prevent propagation of cracks generated at low temperatures. Since polygonal ferrite may be relatively coarser than acicular ferrite, it may contribute relatively little to the increase in strength, but may have a low dislocation density and large inclined angle grain boundaries, and may be a microstructure that contributes greatly to suppressing the propagation at low temperatures.

When the total of the polygonal ferrite and the acicular ferrite is less than 30 area %, it may be difficult to suppress resistance to crack initiation and propagation at low temperature, and it may be difficult to ensure high strength. Therefore, the sum of the polygonal ferrite and the acicular ferrite is preferably 30 area % or more, more preferably 40 area % or more, and even more preferably 50 area % or more.

Since the MA phase does not accept deformation due to its high hardness, not only to concentrate the deformation of the soft ferrite matrix in the peripheral portion, but also to separate the interface with the surrounding ferrite matrix above its limit, or to destroy the MA phase itself, the MA phase may act as an initiation point of crack initiation, and may be the most important cause of deteriorating the low-temperature fracture characteristics of the steel. Therefore, the MA phase should be controlled to be as low as possible, and it is preferable to control the MA phase to 3.0 area % or less.

In this case, the MA phase may have an average size of 2.5 μm or less, when measured at an equivalent circular diameter. When the average size of the MA phase is more than 2.5 μm, the MA may be more likely to be broken due to more concentrated stress, and may act as an initiation point of cracks.

In this case, the polygonal ferrite and the acicular ferrite may not have been hardened by the hot-rolling operation. For example, it may be produced after the hot-rolling operation.

When the hot-rolling temperature is low, coarse pro-eutectoid ferrite may be produced before the hot-rolling finish, and after that, it may be stretched by rolling and may be hardened. The remaining austenite may remain in a band form and may be transformed into a structure having high density of hardened MA phase at the same time, such that the low-temperature impact characteristics and the CTOD value of the steel material may deteriorate.

The microstructure of the steel material of the present disclosure may include bainitic ferrite, cementite, and the like, in addition to the above polygonal ferrite, acicular ferrite, and MA phase.

Further, the steel material of the present disclosure may include inclusions, wherein inclusions having a size of 10 μm or more, among the inclusions, may have $11/cm^2$ or less. The size may be a size measured in the equivalent circular diameter.

When the inclusions having a size of 10 μm or more are more than $11/cm^2$, there arises a problem of acting as a crack initiation point at low temperature. In order to control the coarse inclusions in this way, it is preferable to introduce Ca or a Ca alloy thereinto at a final stage of secondary refining operation, and bubbling and refluxing with Ar gas for at least 3 minutes after the Ca or Ca alloy is introduced.

The steel material of the present disclosure may have a yield strength of 480 MPa or more, an impact energy value at −40° C. of 200 J or more, and a CTOD value at −20° C. of 0.25 mm or more. The steel material of the present disclosure may have a tensile strength of 560 MPa or more.

Further, the steel material of the present disclosure may have a ductile-brittle transition temperature (DBTT) of −60° C. or less.

A method for manufacturing a high-strength steel material, having enhanced resistance to crack initiation and propagation at low temperature Hereinafter, a method for manufacturing a high-strength steel material, having enhanced resistance to crack initiation and propagation at low temperature, which is another aspect of the present disclosure, will be described in detail.

A method for manufacturing a high-strength steel material, having enhanced resistance to crack initiation and propagation at low temperature, which is another aspect of the present disclosure, may include: preparing a slab satisfying the above-described alloy composition; heating the slab to a temperature of 1000° C. to 1200° C.; finish hot-rolling the heated slab to at a temperature of 650° C. or higher to obtain a hot-rolled steel sheet; and cooling the hot-rolled steel sheet.

Slab Preparation Operation

A slab satisfying the above-described alloy composition may be prepared.

In this case, the preparing the slab may further include introducing Ca or a Ca alloy into a molten steel at a final stage of secondary refining operation, and bubbling and refluxing with Ar gas for at least 3 minutes after the Ca or Ca alloy is introduced. This is to control coarse inclusions.

Slab Heating Operation

The slab may be heated to 1000° C. to 1200° C.

When the heating temperature of the slab is less than 1000° C., it may be difficult to re-dissolve carbides generated in the slab during the continuous casting process, to lack homogenization of the segregated elements. Therefore, it is preferable to heat the steel sheet to 1000° C. or higher, at which 50% or more of the added Nb may be re-dissolved.

When the heating temperature of the slab exceeds 1200° C., the austenite grain size may grow excessively large, and further fineness may be insufficient due to the subsequent rolling operation. Therefore, the mechanical properties such as tensile strength and low temperature toughness of the steel sheet may greatly deteriorate.

Hot-Rolling Operation

The heated slab may be subjected to hot-rolling at a temperature of 650° C. or higher, to obtain a hot-rolled steel sheet.

When the finish hot-rolling temperature is less than 650° C., Mn and the like may be not segregated during the rolling operation, and pro-eutectoid ferrite may be produced in a region with low quenchability, and C or the like which has been dissolved due to ferrite formation may be segregated and concentrated into a residual austenite region. As a result, during the cooling operation after the rolling operation, the region in which C and the like is concentrated may be transformed into an upper bainite, martensite or MA phase, and a strong layered structure composed of ferrite and a hardened micro structure may be produced. The hardened micro structure of the C-concentrated layer may have not only a high hardness, may increase but also the fraction of the MA phase. As a result, the increase of the hard structure and the arrangement in the layered structure may greatly deteriorate the low temperature toughness. Therefore, the rolling finish temperature should be limited to 650° C. or higher.

Cooling Operation

The hot-rolled steel sheet may be cooled.

In this case, the hot-rolled steel sheet may be cooled to a cooling end temperature of 200° C. to 550° C. at a cooling rate of 2° C./s to 30° C./s.

When the cooling rate is less than 2° C./s, the cooling rate may be too slow to allow the coarse ferrite and pearlite transformation section to be avoided, and the strength and low temperature toughness may deteriorate. When the cooling rate exceeds 30° C./s, granular bainite or martensite may be formed to increase the strength, but the low-temperature toughness may greatly deteriorate.

When the cooling end temperature is lower than 200° C., there is a high possibility that martensite or an MA phase may be formed. When the cooling end temperature is higher than 550° C., microstructures such as acicular ferrite may be hardly generated, and coarse pearlite may be likely to be formed.

Meanwhile, as necessary, the cooled hot-rolled steel sheet may further include a tempering operation of heating the cooled hot-rolled steel sheet to a temperature of 450° C. to 700° C., maintaining the steel sheet for (1.3*t+10) minutes to (1.3*t+200) minutes, and cooling the steel sheet. The t is a value obtained by measuring a thickness of the hot-rolled steel sheet in mm units.

When MA is excessively generated, MA may be decomposed, high dislocation density may be removed, and dissolved Nb or the like, even in a relatively small amount, may be precipitated, as carbonitride, to further improve the yield strength or the low temperature toughness.

When the heating temperature is lower than 450° C., softening of the ferrite matrix may be not sufficient, and embrittlement phenomenon due to P segregation or the like may appear, which may deteriorate the toughness. When the heating temperature is higher than 700° C., recovery and growth of the crystal grains may occur rapidly, and when the temperature is higher than the above, the steel sheet may be partially transformed into austenite, the yield strength thereof may be greatly lowered, and the low temperature toughness thereof may deteriorate.

When the maintaining time is less than (1.3*t+10) minutes, the homogenization of the structure may be not sufficiently performed, and when the maintaining time is more than (1.3*t+200) minutes, the productivity thereof may be lowered.

MODE FOR INVENTION

Hereinafter, the present disclosure will be described more specifically by way of examples. It should be noted, however, that the following examples may be intended to illustrate the present disclosure in more detail and not to limit the scope of the present disclosure. The scope of the present disclosure may be determined by the matters set forth in the claims and the matters reasonably inferred therefrom.

Slabs having a composition illustrated in the following Table 1 were heated, hot-rolled, and cooled under the conditions illustrated in the following Table 2, to produce steel materials.

A microstructure of the steel materials thus prepared was observed, and properties thereof were measured and are illustrated in the following Table 3.

After welding the above prepared steel materials at the welding heat input illustrated in the following Table 2, impact energy values (−40° C.) and CTOD values (−20° C.) of a weld heat-affected zone (SCHAZ), were measured and listed in the following Table 3. Since impact energy values (−40° C.) and CTOD values (−20° C.) of the steel materials were higher than those of the weld heat-affected zone, the steel materials were not separately measured.

In this case, regarding microstructures of the steel materials, cross-sections of the steel materials were mirror polished, and etched with Nital or LePera in accordance with the purpose, and certain areas of specimens thereof were measured with an optical or scanning electron microscope at a magnification of 100 to 5000 times. Then, fractions of phases were measured from the measured images using an image analyzer. In order to obtain statistically significant values, the same specimens were repeatedly measured by changing their positions, and the average values thereof were determined.

In addition, the numbers of inclusions having a size of 10 μm or more were measured by scanning with a scanning electron microscope, and were listed in the inclusions columns of the following Table 3 (/cm$^2$).

The properties of the steel materials may be described by measuring from the nominal strain-nominal stress curve obtained by conventional tensile tests.

The impact energy values (−40° C.) and DBTT values of the weld heat-affected zone were measured by Charpy V-notch impact test.

The CTOD values (−20° C.) were determined by machining the specimens in sizes of B (thickness)×B (width)×5B (length) perpendicular to a rolling direction according to BS 7448 standard, inserting fatigue crack thereinto to make the fatigue crack length approximately 50% of the specimens, and performing the CTOD test at −20° C. In this case, the B is a thickness of the produced steel material.

TABLE 1

| | | Alloy Composition (wt %) | | | | | | | | | | | | | | | | |
|---|---|---|---|---|---|---|---|---|---|---|---|---|---|---|---|---|---|---|
| | Steel | C | Si | Mn | P | S | Sol. Al | Cu | Ni | Cr | Mo | Ti | Nb | V | N | Ca | O | ***R1 |
| *IS | A | 0.035 | 0.018 | 1.82 | 0.005 | 0.0016 | 0.011 | 0.27 | 0.95 | 0.03 | 0.192 | 0.013 | 0.011 | 0.001 | 0.0036 | 0.0019 | 0.0008 | 0.30 |
| | B | 0.052 | 0.007 | 2.06 | 0.005 | 0.0014 | 0.012 | 0.16 | 0.62 | 0.02 | 0.082 | 0.013 | 0.008 | 0.002 | 0.0032 | 0.0012 | 0.0009 | 0.39 |
| | C | 0.063 | 0.015 | 2.11 | 0.004 | 0.0012 | 0.014 | 0.19 | 0.56 | 0.01 | 0.051 | 0.011 | 0.012 | 0.003 | 0.0029 | 0.0023 | 0.0012 | 0.47 |
| **CS | D | 0.045 | 0.181 | 1.92 | 0.005 | 0.0015 | 0.019 | 0.33 | 0.85 | 0.02 | 0.079 | 0.012 | 0.007 | 0.001 | 0.0031 | 0.0014 | 0.0007 | 0.60 |
| | E | 0.075 | 0.032 | 1.95 | 0.005 | 0.0022 | 0.032 | 0.33 | 0.92 | 0.02 | 0.003 | 0.012 | 0.01 | 0.002 | 0.0037 | 0.0019 | 0.0014 | 0.73 |
| | F | 0.032 | 0.045 | 1.62 | 0.005 | 0.0021 | 0.013 | 0.22 | 0.66 | 0.02 | 0.004 | 0.012 | 0.013 | 0.001 | 0.0033 | 0.0014 | 0.0009 | 0.34 |
| | G | 0.055 | 0.093 | 1.77 | 0.005 | 0.0016 | 0.007 | 0.35 | 0.83 | 0.02 | 0.002 | 0.013 | 0.01 | 0.001 | 0.0032 | 0.0015 | 0.0032 | 0.44 |
| | H | 0.057 | 0.099 | 2.35 | 0.003 | 0.0013 | 0.014 | 0.01 | 0.98 | 0.01 | 0.003 | 0.012 | 0.003 | 0.002 | 0.0038 | 0.0021 | 0.0015 | 0.52 |
| | I | 0.068 | 0.061 | 2.13 | 0.004 | 0.0012 | 0.015 | 0.03 | 1.33 | 0.02 | 0.005 | 0.01 | 0.005 | 0.001 | 0.0042 | 0.0022 | 0.0016 | 0.55 |

*IS: Inventive Steel,
**CS: Comparative Steel,
***R1: Relational Expression (1).

TABLE 2

| | Steel | Thickness of Product (mm) | Slab Heating Temp. (° C.) | Finish Rolling Temp. (° C.) | Cooling Rate (° C./s) | Cooling End Temp. (° C.) | Welding Heat Input (kJ/cm) |
|---|---|---|---|---|---|---|---|
| *IE1 | A | 80 | 1080 | 820 | 5 | 420 | 45 |
| IE2 | B | 51 | 1030 | 800 | 9 | 370 | 25 |
| IE3 | C | 100 | 1115 | 760 | 3 | 320 | 25 |
| **CE1 | D | 76 | 1120 | 780 | 6 | 520 | 35 |
| CE2 | E | 51 | 1170 | 720 | 12 | 330 | 25 |
| CE3 | F | 76 | 1110 | 820 | 6 | 460 | 25 |
| CE4 | G | 76 | 1140 | 800 | 7 | 420 | 25 |
| CE5 | A | 51 | 1230 | 880 | 13 | 330 | 7 |

TABLE 2-continued

| | Steel | Thickness of Product (mm) | Slab Heating Temp. (° C.) | Finish Rolling Temp. (° C.) | Cooling Rate (° C./s) | Cooling End Temp. (° C.) | Welding Heat Input (kJ/cm) |
|---|---|---|---|---|---|---|---|
| CE6 | B | 51 | 1080 | 640 | 8 | 320 | 25 |
| CE7 | H | 80 | 1135 | 820 | 5 | 390 | 50 |
| CE8 | I | 76 | 1155 | 850 | 6 | 450 | 25 |

*IE: Inventive Example,
**CE: Comparative Example.

TABLE 3

| | Steel | PF + AF (area %) | MA (area %) | MA Diameter (μm) | Inclusion (/cm$^2$) | Yield Strength (MPa) | Tensile Strength (MPa) | Impact Energy Value (−40° C., J) | CTOD Value (−20° C., mm) | DBTT Value (° C.) |
|---|---|---|---|---|---|---|---|---|---|---|
| *IE1 | A | 48 | 1.5 | 1.2 | 6 | 487 | 616 | 405 | 0.95 | −103 |
| IE2 | B | 36 | 1.7 | 1.7 | 8 | 498 | 643 | 322 | 0.46 | −99 |
| IE3 | C | 41 | 2.2 | 1.3 | 5 | 485 | 621 | 288 | 0.31 | −85 |
| **CE1 | D | 34 | 3.9 | 3.2 | 6 | 488 | 593 | 325 | 0.12 | −39 |
| CE2 | E | 5 | 4.4 | 2.9 | 7 | 533 | 723 | 21 | 0.04 | −33 |
| CE3 | F | 48 | 1.1 | 1.4 | 4 | 423 | 531 | 365 | 0.48 | −89 |
| CE4 | G | 32 | 2.1 | 2.4 | 14 | 487 | 580 | 51 | 0.11 | −36 |
| CE5 | A | 12 | 1.5 | 1.3 | 6 | 524 | 711 | 12 | 0.04 | −32 |
| CE6 | B | 33 | 2.5 | 3.3 | 8 | 485 | 575 | 25 | 0.14 | −23 |
| CE7 | H | 38 | 3.1 | 2.1 | 7 | 486 | 568 | 65 | 0.16 | −51 |
| CE8 | I | 33 | 3.4 | 2.2 | 8 | 502 | 583 | 45 | 0.18 | −48 |

*IE: Inventive Example,
**CE: Comparative Example.

In Table 3, PF+AF refers to the sum of polygonal ferrite and acicular ferrite.

It can be seen that Inventive Examples 1 to 3, which satisfy both the alloy composition and the manufacturing conditions proposed in the present disclosure, had excellent yield strength, and high impact energy value and CTOD value of the heat-affected zone.

As illustrated in Tables 1 to 3, it can be seen that Inventive Examples 1 to 3, which satisfy all of the ranges proposed by the present disclosure, had a high strength of 420 MPa or higher in yield strength, had a high impact absorption energy value in the weld heat-affected zone, had also excellent low temperature toughness in the CTOD value. Therefore, it was proven that they are suitably used for complex and large pressure vessels and shipbuilding and marine structures.

In Comparative Examples 1, 7, and 8, the range of each individual component was included in the scope of the present disclosure, but index values of low temperature hardened phases defined by relational expression (1) exceeded 0.5, which is the range of the present disclosure. As a result, a hardened phase such as MA was promoted in the produced steel material and the weld heat-affected zone, particularly Sub-Critically Reheated Heat-affected zone (SC-HAZ), resulting in a significant deterioration in low temperature toughness.

In Comparative Example 2, added C content exceeded the range of the present disclosure. C may be the most powerful element for promoting MA. In this case, low temperature toughness of the steel materials and the weld heat-affected zones greatly deteriorated in a similar manner to Comparative Example 1.

In Comparative Example 3, added Mn content was below the range of the present disclosure. In this case, the Mn content was greatly low that formation of hardened phase such as MA was greatly reduced. Further, low temperature toughness of the steel materials and the weld heat-affected zones was greatly improved, but there was little strength enhancing effect by Mn. Therefore, high-strength steel material was not obtained.

In Comparative Example 4, the content range of all the elements, other than O, satisfied the range of the present disclosure, but the content of O in the product exceeded the range of the present disclosure because the inclusion production and removal management in the steelmaking process was insufficient. When the removal of O in the steelmaking process was insufficient, finally the non-removed O may be present as an oxidizing inclusion, and its fraction and size may be increased. Such coarse oxidative inclusions may be hardly ductile and may be then broken by rolling load during a low temperature rolling operation in the steelmaking process, to be present in a form of elongated shape in the steel materials. This serves as a path for crack initiation and propagation in subsequent processing or external impact, which ultimately contributes to a significant deterioration of the low temperature toughness of the steel materials and weld heat-affected zone.

In Comparative Examples 5 and 6, all of the steel component compositions satisfied the present disclosure, but the production conditions were out of the scope of the present disclosure.

In Comparative Example 5, reheating temperature of the produced slab exceeded the range of the present disclosure. When the slab reheating temperature was too high, the austenite growth was rapidly promoted due to the rolling at high temperature and the atmosphere, to greatly deteriorate low temperature toughness.

In Comparative Example 6, the finish hot-rolling temperature was lower than the range of the present disclosure. In this case, coarse ferrite was produced before the end of the rolling process, and was then provided as a stretched form in subsequent rolling operation. Further, remaining austenite remained in the form of a band, and transformed into a structure having high density of MA hardened phase. Finally, low temperature toughness deteriorated, due to the coarse and deformed structure and locally high MA hardened phase.

While example embodiments have been illustrated and described above, it will be apparent to those skilled in the art that modifications and variations could be made without departing from the scope of the present disclosure as defined by the appended claims.

The invention claimed is:

1. A high-strength steel material comprising, by weight, carbon (C): 0.01% to 0.07%, silicon (Si): 0.002% to 0.2%, manganese (Mn): 1.7% to 2.5%, Sol. aluminum (Sol.Al): 0.001% to 0.035%, niobium (Nb): 0.03% or less (not including 0%), vanadium (V): 0.01% or less (not including 0%), titanium (Ti): 0.001% to 0.02%, copper (Cu): 0.01% to 1.0%, nickel (Ni): 0.01% to 2.0%, chromium (Cr): 0.01% to 0.5%, molybdenum (Mo): 0.001% to 0.5%, calcium (Ca): 0.0002% to 0.005%, nitrogen (N): 0.001% to 0.006%, phosphorus (P): 0.02% or less (not including 0%), sulfur (S): 0.003% or less (not including 0%), oxygen (O): 0.0025% or less (not including 0%), a balance of iron (Fe), and inevitable impurities, and satisfying relational expression (1), wherein a microstructure of the high-strength steel material comprises polygonal ferrite and acicular ferrite in a total amount of 30 area % or more, and comprises a martensite-austenite composite phase (MA phase) in an amount of 1.1 to 3.0 area %, wherein the MA phase has an average size of 2.5 μm or less, when measured at an equivalent circular diameter, wherein the steel material comprises inclusions, wherein inclusions having a size of 10 μm or more, among the inclusions, has $11/cm^2$ or less, and wherein a weld heat-affected zone has an impact energy value at −40° C. of 200 J to 405 J, and a crack-tip opening displacement (CTOD) value at −20° C. of 0.25 mm or more:

$$5*C+Si+10*sol.Al \leq 0.5 \quad \text{Relational expression (1):}$$

where each symbol of the element refers to a value indicating each element content in weight %.

2. The high-strength steel material according to claim 1, wherein the polygonal ferrite and the acicular ferrite are not hardened by hot-rolling.

3. The high-strength steel material according to claim 1, wherein the steel material has a yield strength of 480 MPa or more.

4. The high-strength steel material according to claim 1, wherein the steel material has a tensile strength of 560 MPa or more.

5. The high-strength steel material according to claim 1, wherein the steel material has a ductile-brittle transition temperature (DBTT) of −60° C. or lower.

6. A method for manufacturing a high-strength steel material according to claim 1, comprising:

preparing a slab comprising, by weight, carbon (C): 0.01% to 0.07%, silicon (Si): 0.002% to 0.2%, manganese (Mn): 1.7% to 2.5%, Sol. aluminum (Sol.Al): 0.001% to 0.035%, niobium (Nb): 0.03% or less (not including 0%), vanadium (V): 0.01% or less (not including 0%), titanium (Ti): 0.001% to 0.02%, copper (Cu): 0.01% to 1.0%, nickel (Ni): 0.01% to 2.0%, chromium (Cr): 0.01% to 0.5%, molybdenum (Mo): 0.001% to 0.5%, calcium (Ca): 0.0002% to 0.005%, nitrogen (N): 0.001% to 0.006%, phosphorus (P): 0.02% or less (not including 0%), sulfur (S): 0.003% or less (not including 0%), oxygen (O): 0.0025% or less (not including 0%), a balance of iron (Fe), and inevitable impurities, and satisfying relational expression (1);

heating the slab to a temperature of 1000° C. to 1200° C.;

finish hot-rolling the heated slab to at a temperature of 650° C. or higher to obtain a hot-rolled steel sheet; and cooling the hot-rolled steel sheet to obtain the high-strength steel material:

$$5*C+Si+10*sol.Al \leq 0.5 \quad \text{Relational expression (1):}$$

where each symbol of the element refers to a value indicating each element content in weight %.

7. The method according to claim 6, wherein the cooling the hot-rolled steel sheet performs to a cooling end temperature of 200° C. to 550° C. at a cooling rate of 2° C./s to 30° C./s.

8. The method according to claim 6, further comprising a tempering operation of heating the cooled hot-rolled steel sheet to a temperature of 450° C. to 700° C., maintaining the steel sheet for (1.3*t+10) minutes to (1.3*t+200) minutes, and cooling the steel sheet (where t is a value obtained by measuring a thickness of the hot-rolled steel sheet in mm units).

9. The method according to claim 6, wherein the preparing the slab further comprises introducing Ca or a Ca alloy into a molten steel at a final stage of secondary refining operation, and bubbling and refluxing with Ar gas for at least 3 minutes after the Ca or Ca alloy is introduced.

10. A high-strength steel material comprising, by weight, carbon (C): 0.01% to 0.07%, silicon (Si): 0.002% to 0.2%, manganese (Mn): 1.7% to 2.5%, Sol. aluminum (Sol.Al): 0.001% to 0.035%, niobium (Nb): 0.03% or less (not including 0%), vanadium (V): 0.01% or less (not including 0%), titanium (Ti): 0.001% to 0.02%, copper (Cu): 0.01% to 1.0%, nickel (Ni): 0.01% to 2.0%, chromium (Cr): 0.01% to 0.5%, molybdenum (Mo): 0.001% to 0.5%, calcium (Ca): 0.0002% to 0.005%, nitrogen (N): 0.001% to 0.006%, phosphorus (P): 0.02% or less (not including 0%), sulfur (S): 0.003% or less (not including 0%), oxygen (O): 0.0025% or less (not including 0%), a balance of iron (Fe), and inevitable impurities, and satisfying relational expression (1), wherein a microstructure of the high-strength steel material comprises polygonal ferrite and acicular ferrite in a total amount of 30 area % or more, and comprises a martensite-austenite composite phase (MA phase) in an amount of 1.1 to 3.0 area %, wherein the MA phase has an average size of 2.5 μm or less, when measured at an equivalent circular diameter, wherein the steel material comprises inclusions, wherein inclusions having a size of 10 μm or more, among the inclusions, has $11/cm^2$ or less, and wherein the high strength material has an impact energy value at −40° C. of 200 J or more, and a crack-tip opening displacement (CTOD) value at −20° C. of 0.25 mm or more:

$$5*C+Si+10*sol.Al \leq 0.5 \quad \text{Relational expression (1):}$$

where each symbol of the element refers to a value indicating each element content in weight %.

* * * * *